US005884728A

United States Patent [19]

d'Estaintot et al.

[11] Patent Number: 5,884,728

[45] Date of Patent: Mar. 23, 1999

[54] ASSEMBLY FOR CHECKING AND REGISTERING PURCHASES IN A SELF-SERVICE SALES POINT

[75] Inventors: Pierre d'Estaintot, Meu Don; Jean-Charles Detallante, Paris, both of France

[73] Assignee: Societe Anonyme des Marches Usines-Auchan, Villeneuve D-Ascq, France

[21] Appl. No.: 716,035

[22] Filed: Sep. 19, 1996

[30] Foreign Application Priority Data

Sep. 20, 1995 [FR] France ..... 95 11021

[51] Int. Cl.[6] ..... A47F 9/04

[52] U.S. Cl. ..... 186/62; 186/66

[58] Field of Search ..... 186/61–69

[56] References Cited

U.S. PATENT DOCUMENTS

| | | | |
|---|---|---|---|
| 3,270,837 | 9/1966 | Lachance | 186/64 |
| 3,557,907 | 1/1971 | Close | 186/62 |
| 3,990,540 | 11/1976 | Aleshire et al. | 186/61 |
| 4,792,018 | 12/1988 | Humble et al. | 186/61 |
| 4,953,664 | 9/1990 | Vrooman et al. | 186/61 X |
| 5,149,947 | 9/1992 | Collins | 186/62 |
| 5,211,263 | 5/1993 | Davidson et al. | 186/61 |
| 5,492,199 | 2/1996 | Shimoyama | 186/61 |

FOREIGN PATENT DOCUMENTS

| | | | |
|---|---|---|---|
| 652131 | 9/1964 | Belgium . | |
| 0449248 | 8/1991 | European Pat. Off. . | |
| 1357750 | 3/1964 | France . | |
| 2711901 | 5/1995 | France . | |
| 924901 | 5/1963 | United Kingdom | 186/66 |
| 973444 | 10/1964 | United Kingdom . | |

OTHER PUBLICATIONS

G. J. Laurer, "Multiple Supermarket Check Stand", IBM Tech. Disclosure Bulletin, vol. 19, No. 9, Feb. 1977, pp. 3531–3533.

*Primary Examiner*—F. J. Bartuska
*Attorney, Agent, or Firm*—Fisher,Christen&Sabol

[57] ABSTRACT

An assembly for checking an registering purchases made by a consumer in a self-service sales point. The assembly includes a station for unloading the pruchases, a work station provided with apparatus for registering and accounting the purchases adapted to be occupied by one person, and a loading station, wherein the respective unloading and loading station being placed substantially opposite each other and on either side of work station. The loading station involves a location adapted to receive a trolley. The person faces the registering and accounting apparatus having at the person's right or left the unloading deck and at the person's left or right, respectively, the trolley. The unit includes at least two such assemblies. The sales point of the self-service type is provided with at least two such units.

1 Claim, 8 Drawing Sheets

FIG. 3B
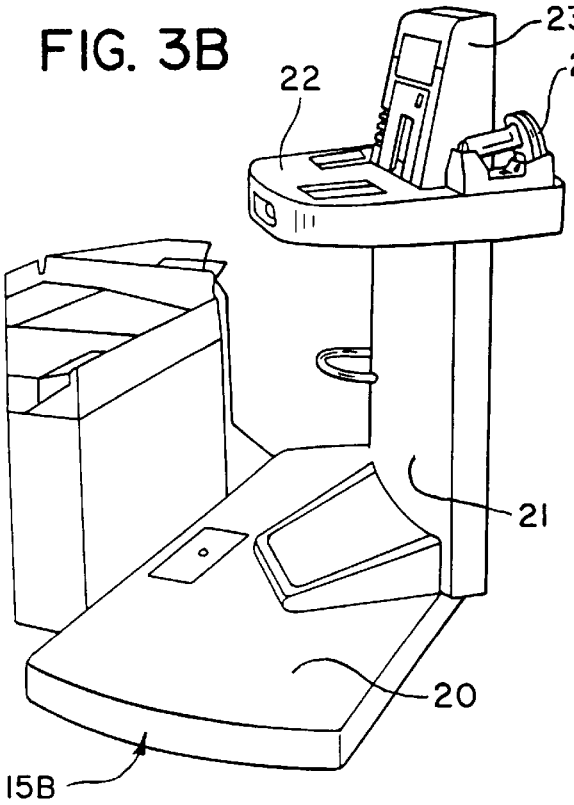
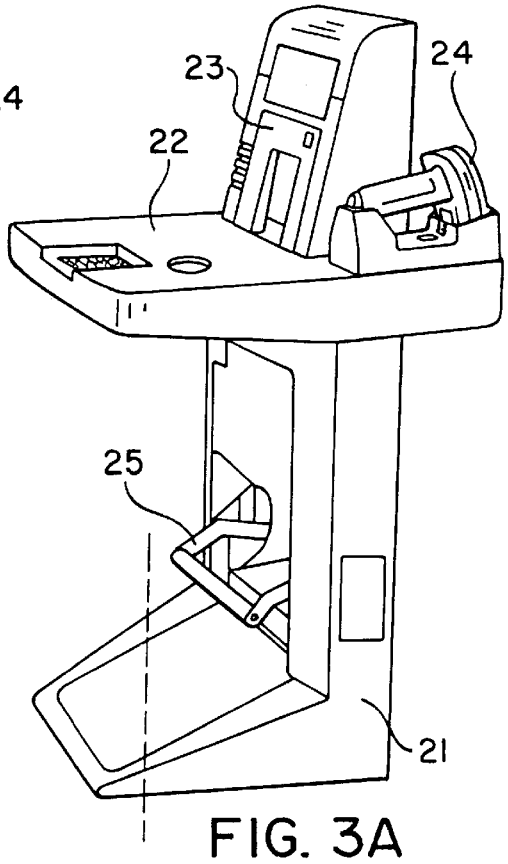
FIG. 3A
FIG. 5
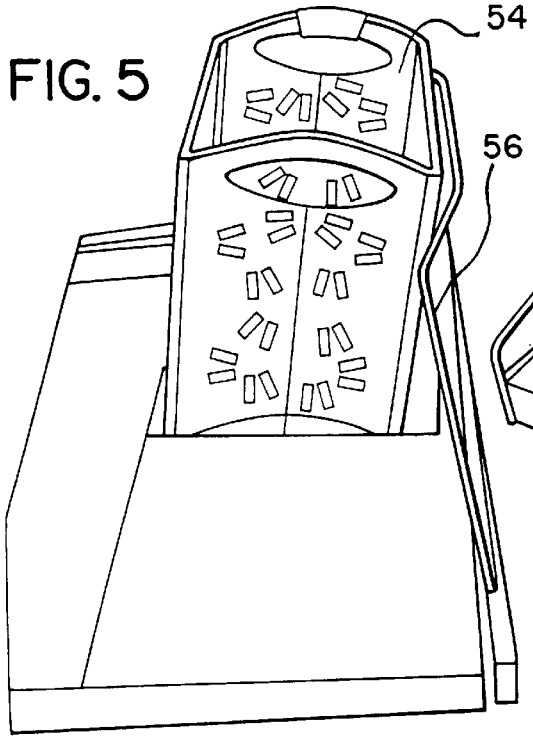
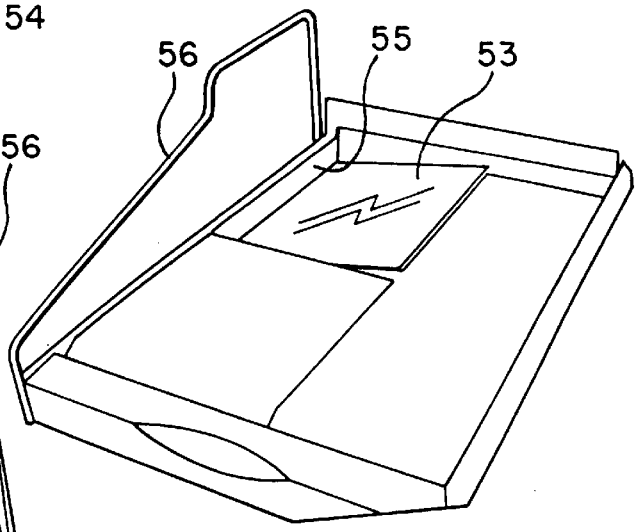
FIG. 6

ASSEMBLY FOR CHECKING AND REGISTERING PURCHASES IN A SELF-SERVICE SALES POINT

FIELD OF THE INVENTION

The present invention relates to an assembly intended for checking and registering purchases made in a self-service type selling point by a consumer using a container and/or trolley.

BACKGROUND OF THE INVENTION

In self-service stores, the goods taken from the shelves by the consumer are usually placed in trolleys or containers provided to that end. The consumer then heads towards one of the exit stations, commonly known as "cashdesks" or "check-outs".

Heretofore employed check-out stations comprise a conveyor belt onto which the consumer unloads the goods contained in the trolley.

The cashier (hereinafter referred to as the operator) takes the articles one by one to register them with the aid of a cash register which memorizes the price and name of the article, indicated by a so-called bar code disposed on the article. The operator captures the data from the bar code either manually or automatically with the aid of a laser reader (scanner). The operation is thus continued until all the goods selected by the consumer have been registered. The consumer then pays for the total amount of the goods purchased. Payment is made at the same station as the registration and by the same operator. Concomitantly, and more generally after the operation of payment, the consumer must reload his/her trolley, placing either the articles themselves or the articles placed in plastic bags that the operator provided as registration was being effected.

This known way of proceeding and the means used present numerous drawbacks.

Firstly, these known means do not allow, or only with difficulty, the use of a container disposed on the trolley or of a container belonging to the consumer.

Unloading, registration, payment and reloading of the trolley are effected at the same station and by the same operator. These operations must be effected virtually sequentially, which consequently increases the time necessary for every consumer to effect all of these operations; the consumer is therefore obliged to remain a relatively long time at the cashdesk to effect these operations. Furthermore, the operations of unloading, registration and payment effected by the same person increase the complexity of the tasks that one and the same operator must perform.

From the standpoint of security, the fact of having relatively large sums of money, whether it be in the form of cheques, cash or credit card payments, handled by an operator occupied with other tasks and who must cope with a continuous sequence of operations, increases the risks of error.

The absence of use of container by the consumer, or of container supplied by the store itself, involves consuming a large number of plastic bags for collecting the goods together and loading them again in the trolley. The budget relative to plastic bags is high, up to several hundreds of thousands of francs for one year in one store. Any reduction in consumption of plastic bags, without sacrificing the conviviality and convenience of shopping, would thus enable substantial savings to be made and would also certainly be advantageous from the environmental standpoint.

The reduction in the time spent by each customer at the check-out leads to reducing his/her stress; it is, in fact, important to develop customers' loyalty by providing pleasant conditions when shopping, with reduced waiting time.

Furthermore, self-service store management must take into account the indiscretions not only of the customer but also of the staff, also known as "connivance trolley", which consists, for a cashdesk operator, in registering articles and/or prices which have no connection with those actually present in the trolley and taken away by the customer, with the operator's complicity. The present system does not make it possible to fight such intrigues efficiently.

The known systems and methods are thus observed to present numerous drawbacks concerning both the customers and the management of the selling point.

In this context, the present invention aims at overcoming these drawbacks and proposes a method and means for carrying it out, enabling a consumer to register the articles purchased, to pay the price thereof and to leave the store after a waiting time reduced to a minimum. The method and the device of the invention also aims at optimalizing management of the staff at the self-service store check-outs, both from the qualitative and quantitative standpoints, while improving security and reducing the risks of "connivance trolleys".

SUMMARY OF THE INVENTION

To that end, according to the invention, the assembly for checking and registering purchases made by a consumer in a self-service sales point, of the type comprising a station for unloading said purchases from a trolley and/or a container, a work station provided with means for registering and accounting said purchases, adapted to be occupied by one person, further comprises a loading station, said respective unloading and loading stations being placed substantially opposite each other and on either side of said work station.

The loading station preferably comprises a location adapted to receive a trolley.

In order to facilitate handling of the goods, the unloading station comprises a first unloading deck within reach of the person occupying said work station, said first deck being of such shape and dimensions as to allow containers to be supported and maintained stable.

With a view to facilitating the operator's grip on the goods in the container, the first deck comprises a part whose surface corresponds substantially to a container and is inclined, at least in one direction, towards said work station, at least one stop being provided for the corresponding container.

Said unloading station advantageously comprises a second deck, disposed opposite the first deck with respect to said work station, and comprising conveying members such as rollers.

The assembly comprises means for temporarily immobilizing the trolley in said location, such as an electro-magnet.

According to an advantageous characteristic, the work station is mounted to rotate about a vertical axis, with a view to turning the operational face either towards upstream, or towards downstream, allowing said work station to be used equally well either by the consumer (in position facing upstream) or by a check-out operator (in position facing downstream).

More particularly, said work station comprises a seat for the operator, mounted to slide between an active position for use by an operator, and a retracted position for use by the consumer.

The loading station advantageously comprises a preferably retractable deck for supporting a container at least temporarily, before it is placed on the trolley disposed in the location of the loading station.

The invention also relates to a unit for checking and registering purchases made by a consumer in a self-service sales point, characterized in that it comprises at least two assemblies as described and preferably three or four assemblies disposed side by side, about a central point and offset angularly in the general form of a Y, a V or a chevron.

The unit advantageously further comprises at least one separate payment station placed at a distance from said assembly or assemblies.

The invention also concerns a sales point of the self-service type provided with at least two units as described.

BRIEF DESCRIPTION OF THE DRAWINGS

The invention will be more readily understood on reading the following description with reference to the accompanying drawings, in which:

FIGS. 3A and 3B show views in perspective of a work station desk in different positions.

FIG. 5 shows a view in detail of an unloading deck and a container associated therewith.

FIG. 6 shows the same deck without container.

DESCRIPTION OF PREFERRED EMBODIMENTS

Figure 1:
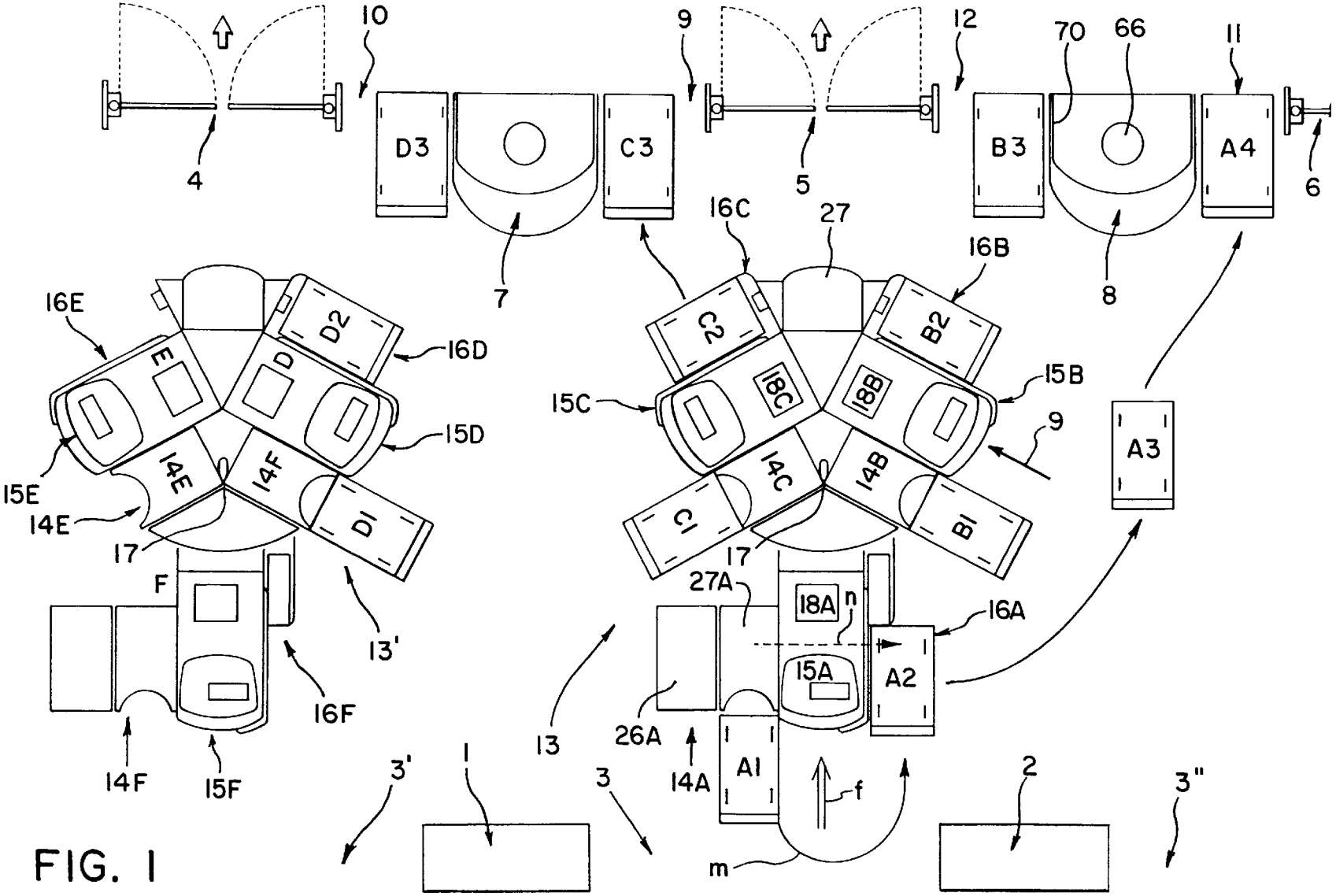
FIG. 1 is a schematic plan view of an implantation of assemblies according to the invention.

Referring now to the drawings, and firstly to FIG. 1, an example of implantation of several assemblies according to the invention, grouped together and disposed at the exit of a self-service type store, and more particularly of the super- or hypermarket type, will be described hereinafter.

Shelves 1 and 2 have been shown partially and schematically in alignment and parallel; only two shelves have been shown for reasons of convenience. Between each shelf are provided aisles 3, 3', 3" to enable the consumers and their trolleys to move around. The limit of the store is schematically represented by barriers bearing respective references 4, 5, 6, leaving therebetween a passage in each of which is disposed a payment station. Two passages are thus shown respectively between barriers 4 and 5 on the one hand, and 5 and 6 on the other hand. In each passage there is disposed a payment station referenced 7 and 8 respectively which will be described hereinbelow in greater detail.

Between a payment station and the corresponding barrier, there is provided a passage for the consumer, presenting a width of the order of 90 cm in order to allow passage for wheelchairs. For example, between the payment station 7 and barriers 4 and 5 there are respectively provided passages 9 and 10 via which the consumers leave the store towards the exit, such displacement being symbolized by arrows i, j. Similarly, between payment station 8 and respective barriers 5 and 6 there are provided respective passages 11 and 12 for the customers and their trolleys, in a direction of advance symbolized by arrows k and l, parallel to arrows i and j.

Between the line materialized by the exit barriers, on the one hand, and the shelves 1, 2 for presenting the goods, on the other hand, there are provided units for checking, registering and unloading the goods. More precisely, two of these units are schematically shown, generally referenced 13 and 13' respectively. Unit 13 comprises three unloading, registering, checking and loading assemblies, disposed contiguously and bearing general references A, B and C. Each assembly is composed of different elements bearing indices A, B and C, associated with the references of each of the elements. For example, assembly B comprises an unloading station 14A, a work station for checking and registering the goods, referenced 15A, and a loading station 16A. Similarly, assemblies B and C comprise an unloading station 14B and 14C respectively, a work station 15B and 15C, and a loading station 16B and 16C.

For each of assemblies A, B, C, trolleys have been schematically shown, of known type and commonly used in self-service type stores. The trolley associated with assembly A, for example, thus bears references A1 in unloading position and A2 in loading position. Once the trolleys have been reloaded with the accounted goods, they are guided by the consumer towards the payment stations, such as for example the trolley shown at A3 and A4 of assembly A.

Figure 2C:
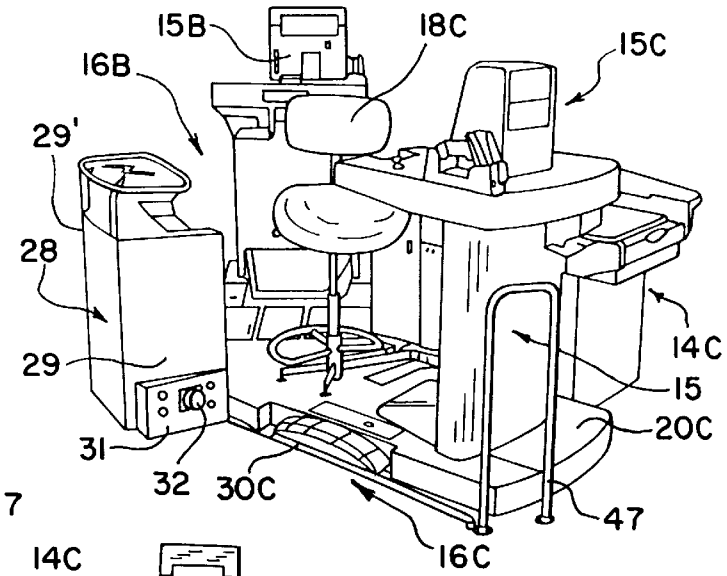
FIGS. 2A, 2B and 2C show downward views in perspective of a unit comprising a plurality of checking assemblies according to the invention.
Figure 2A:
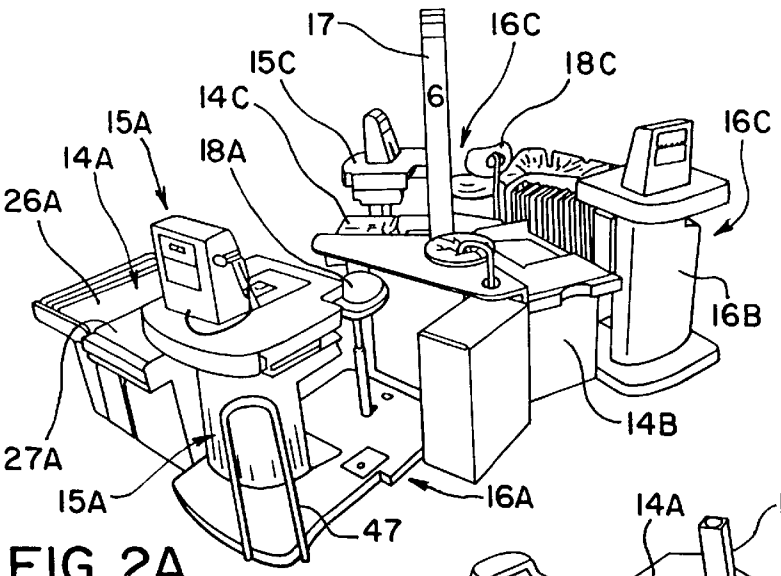
Figure 2B:
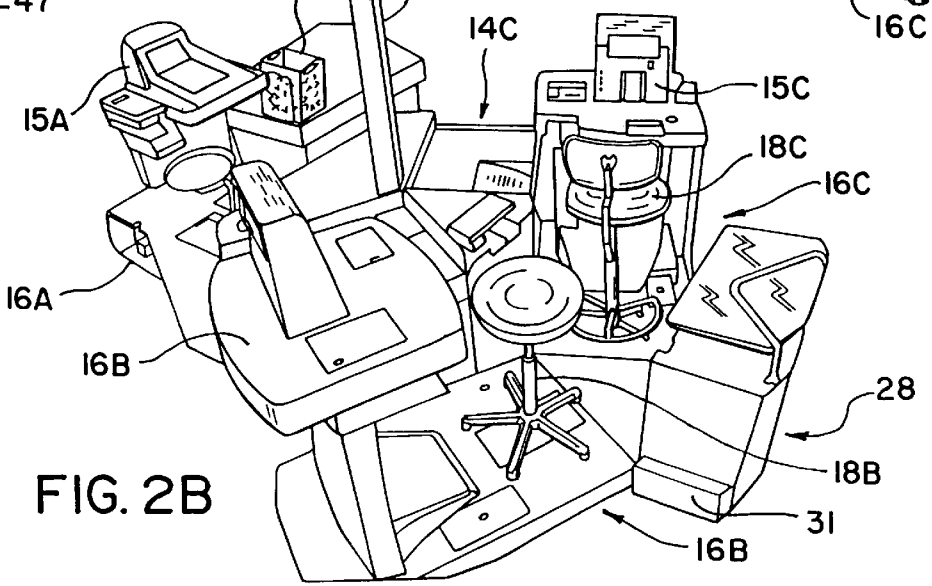

FIGS. 2A and 2B show downward views in perspective, at different angles, of unit 13, composed of three assemblies A, B and C, of FIG. 1.

FIGS. 2A and 2B show the same elements bearing the same references, and in particular the unloading stations 14A, 14B and 14C, the work stations 15A, 15B and 15C, the loading stations 16A, 16B and 16C. The assemblies are disposed with respect to one another to form the unit 13, about a central point symbolized by the marking pole 17. Assemblies A, B and C are thus disposed angularly offset to form a sort of Y whose centre is represented by the pole 17.

Reference will hereinafter be made to the general direction of advance for each assembly, symbolized by an arrow, respectively f for assembly A, g for assembly B and h for assembly C. These directions are such that they are perpendicular to the work station, more precisely, each direction is such that the operator, in position at his/her work station, is facing it.

Each work station 15A, 15B and 15C comprises a seat for the operator. Only seats 18A and 18C have been shown.

FIG. 2C shows the two assemblies B and C, seen from the unloading station 16C of assembly C.

FIGS. 3A and 3B show in perspective a work station, for example station 15B, which comprises a base or platform 20, generally parallelepipedic and elongated in form, on which is rotatably mounted, as explained hereinafter, a pedestal 21 at the top of which are provided a panel 22 and a console 23. The latter is associated with and includes registering and checking means known per se and comprising a fixed bar code reader and a mobile reader 24 of the scanner type. The corresponding seat, which has not been shown for reasons of clarity, is fixed on the platform 20. A footrest 25 is provided on the pedestal for the operator's comfort. The fixed scanner and the mobile scanner 24 translate the bar code displayed on the articles, into data relative to the price of the article and identification thereof, said data being progressively memorized and displayed in known manner by the console 23. The registering and checking means are associated with calculating and printing means.

Referring back to FIGS. 1, 2A and 2B, it is observed that the unloading station 14A comprises a principal deck 27A, disposed near the work station 15A, and an auxiliary deck 26A contiguous with the principal deck 27A, opposite the latter with respect to the work station 15A. The auxiliary deck 26A comprises conveying means, such as rollers or a conveyor belt, so as to enable the containers to be disposed on the auxiliary deck 26A to be displaced, without effort or with a minimum of effort, towards the principal deck 27A.

Still referring to the same Figures, the work station 15A, 15B and 15C, of each assembly is disposed between the unloading station and the loading station, these three stations being substantially of general direction parallel to the general direction of advance and displacement of the consumer, as mentioned hereinabove, and corresponding to respective arrows f, g, h.

Each unloading station is constituted by a location of shape and dimensions corresponding substantially to a trolley of the self-service type. FIG. 2C shows the location corresponding to the loading station 16C, said location being defined by the edges of the platform 20C, the work station 15C, and a support 28 in the form of a parallelepipedic cabinet disposed between the two loading stations 16B and 16C. The cabinet 28 thus comprises two vertical walls 29 and 29', parallel to the direction of advance. Wall 29 of the cabinet 28 and the edge of the platform 20C thus form a sort of L in plan view, corresponding to the loading station 16C adapted to receive a trolley. A guide rail 30C is provided along the edge of the platform 20C. The wall 29 of the cabinet 28 is provided at its base with means for temporarily immobilizing the trolley, bearing reference 31. These immobilizing means are preferably constituted by an electric circuit comprising an electro-magnet 32 adapted to cooperate with a corresponding plate fixed on the trolley. In this way, when the trolley abuts against the means 31, the metal plate placed on the trolley comes into contact with the electro-magnet 32, which makes it possible to immobilize the trolley. Such temporary immobilization is not compulsory but makes it possible, on the one hand, to avoid any untimely movement of the trolley during loading and, on the other hand, to block the trolley to avoid any doubtful or indelicate action by a consumer. The electro-magnet is controlled automatically via a contactor disposed at the centre of the support of the electro-magnet 32. The contactor, as soon as the plate of the trolley abuts against the electro-magnet, provokes supply thereof and therefore immobilization of the trolley. During usual operation, the trolley is released from the unloading station (for example 16A) by cutting the supply of the electro-magnet. Supply of the latter is cut off automatically by the transmission by the registering and accounting means to the work station of the total amount representing the goods disposed in the trolley and accounted for, and the emission of a corresponding ticket for the customer/consumer. In a variant, it is possible to provide manual hold and/or release of the trolley either by the operator at the work station intervening, or by the operator at the payment station located downstream, intervening. Holding the trolley at the loading station also presents the advantage of limiting the untimely movements thereof during loading, for the customer's convenience.

When referring to the directions of advance of the consumer as mentioned hereinabove, the terms "upstream" and "downstream" will generally be used, to locate the elements with respect to one another in these directions.

Reference will now be made to FIGS. 4A to 4G, to describe the principle of use of each checking and registering assembly. It is understood that FIGS. 4A to 4G show only a part of the corresponding assembly being used, and at different angles in order to facilitate understanding.

Figure 4A:
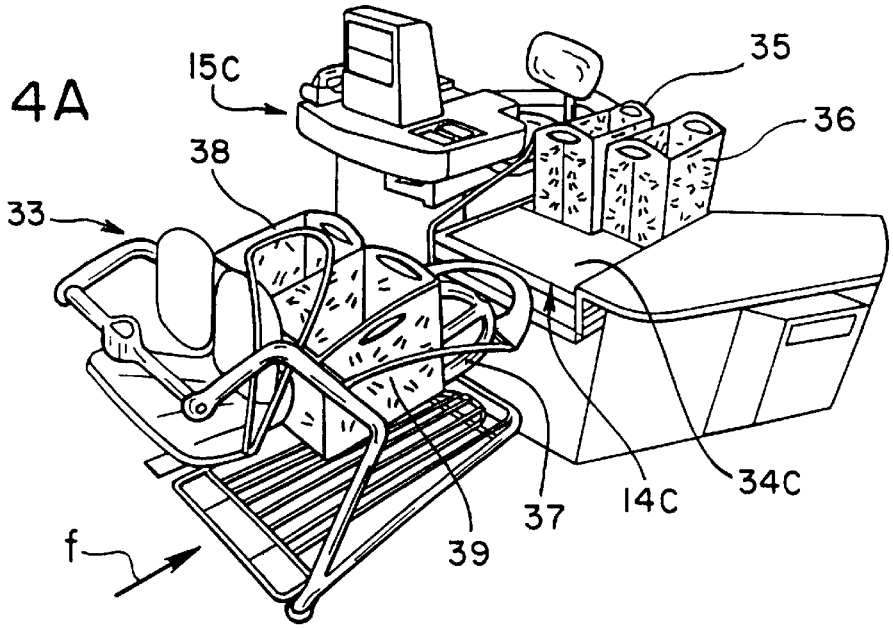
FIGS. 4A, 4B, 4C, 4D, 4E, 4F, 4G show in perspective assemblies of the invention at different stages of unloading, checking, registering and loading of a trolley, and at different angles.

Starting from the position shown in FIG. 4A, a trolley 33 is disposed near and against a corresponding unloading station 14C, constituted by a deck 34C on which the goods may be placed, either in bulk or disposed in containers. The containers are preferably parallelepipedic with an upper opening. Two containers 35 and 36 are shown for example on the deck 34C, while the trolley 33 comprises on its upper deck 37 two containers 38 and 39. The arrangement of the trolley 33, the unloading deck 34C and the work station 15C, is such that these latter present a general orientation parallel to one another, and also parallel to the general direction of advance of the consumer (arrow f).

The consumer unloads his/her trolley 33, placing the containers 35, 36, 38, 39 on the unloading deck 34C. The latter presents such a shape and dimensions that it can support four containers in the example shown.

Figure 4B:
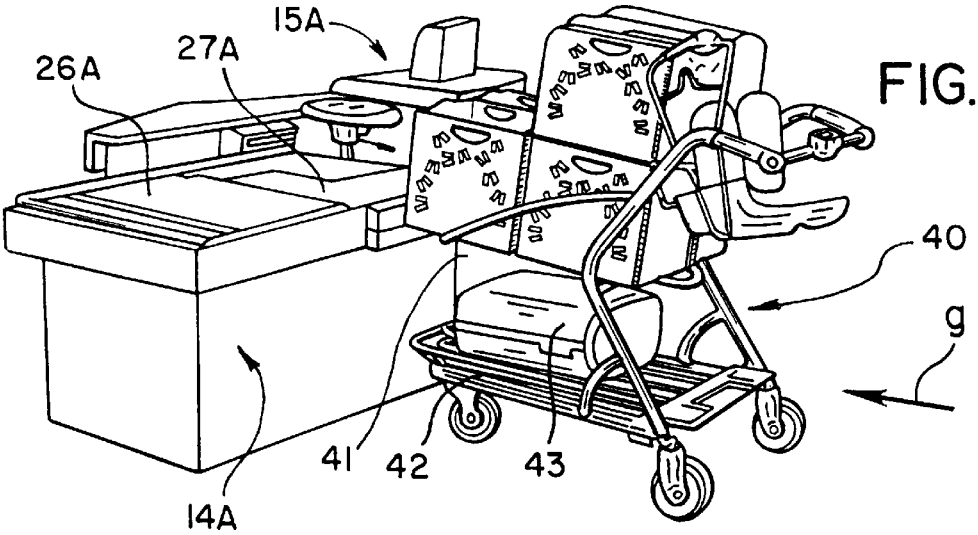

FIG. 4B shows assembly A against which is disposed a trolley 40, whose upper deck 41 comprises two series of four superposed containers, and whose lower deck 42 comprises voluminous goods, represented by unit 43. Trolley 40 is placed opposite the unloading means 14A. The consumer then displaces the containers arranged on the trolley, onto the unloading station. A trolley comprising eight containers disposed in two layers of four containers, superposed and stacked in two's, is taken as an example. In a first step, the consumer unloads the four containers of the upper part, placing them on the auxiliary unloading station 26A. In a second step, the consumer then unloads the four remaining containers disposed on the trolley, placing them on the principal unloading deck 27A. The trolley is then empty and it is displaced towards the loading station. As the containers are accounted and removed by the work station operator, the principal deck 27A is freed and it is then possible for the operator to displace the full containers from the auxiliary deck 26A towards the principal deck 27A, thanks to the conveying means (rollers, conveyor belt or the like), presenting a work direction directed towards the corresponding work station.

Figure 4C:
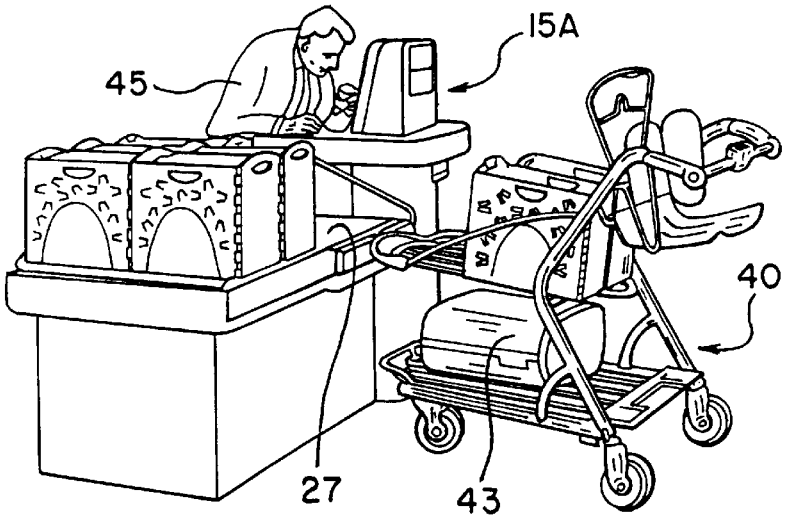

FIG. 4C shows the assembly of FIG. 4B, at a subsequent step in which the trolley 40 is partially unloaded, with a plurality of containers disposed on the first auxiliary unloading deck 26A. An operator 45 is shown at the work station 15A.

Figure 4D:
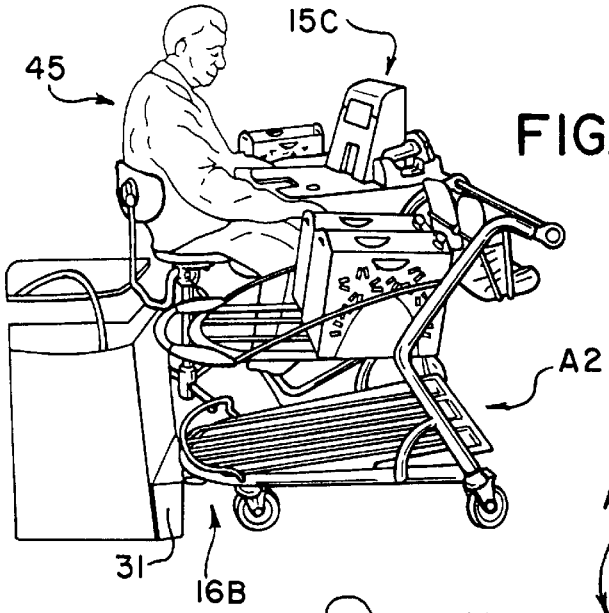
Figure 4F:
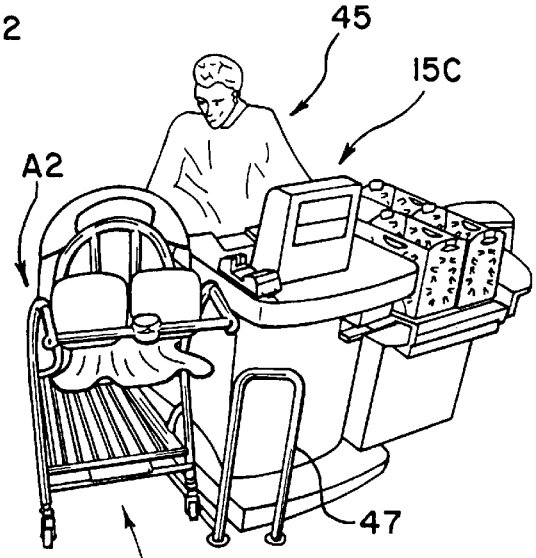
Figure 4E:
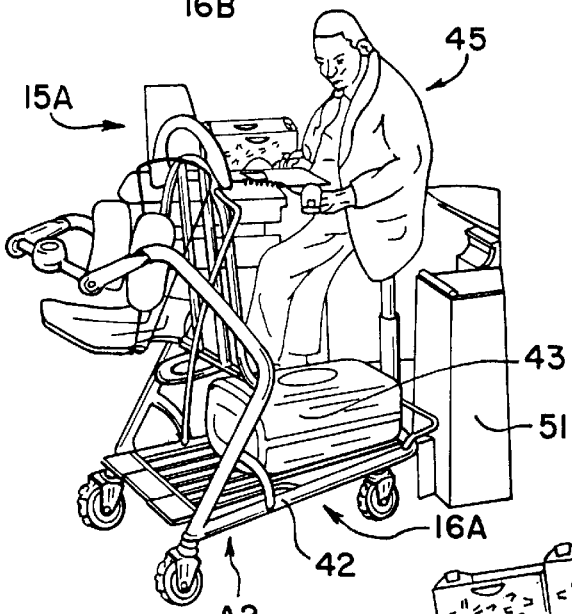
Figure 4G:
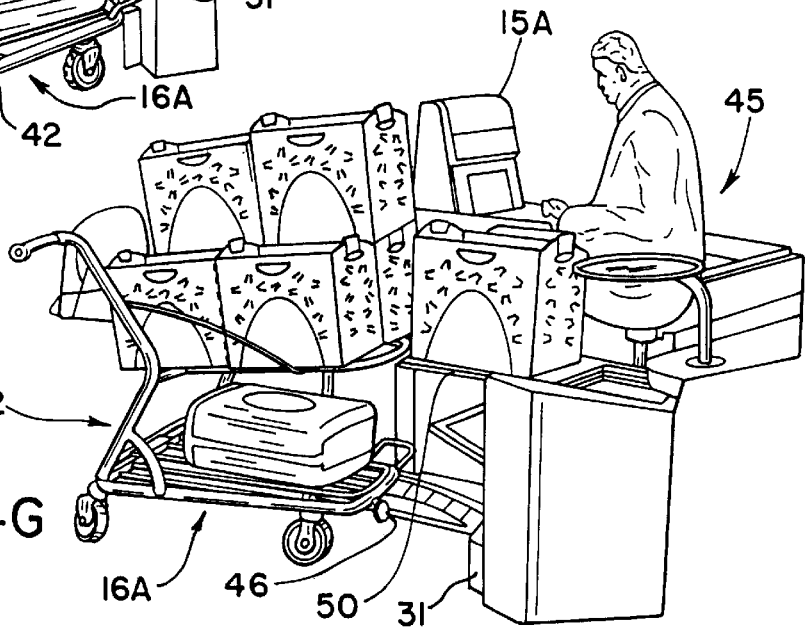

The description of the modus operandi of the invention will be continued hereinafter with reference to FIGS. 1, 4D to 4G. FIGS. 4D and 4F refer to assembly C, while FIGS. 4E and 4G refer to assembly A. As shown in FIG. 1, the trolley A1, disposed near the unloading station 14A, once completely unloaded, is displaced by the consumer towards the loading station 16A, where the trolley is represented by reference A2. The curved arrow m symbolizes the passage of the trolley from its position A1 towards its position A2. FIGS. 4E and 4G show the corresponding trolley A2 in place in the loading station. In this position, the trolley may be immobilized thanks to means 31 and the electro-magnet 32

(FIG. 2C). FIG. 4G shows the trolley in place, albeit offset with respect to the immobilizing means 31 for reasons of clarity. On the front part of the lower deck of the trolley A2, there is a metal plate 46 adapted to cooperate with the electro-magnet 31. FIGS. 4D and 4F show a trolley at the unloading station 15C.

With reference to FIGS. 2C and 4F, a protecting hoop 47 is provided at the corner of the corresponding work stations 15A and 15C to protect the work station when the trolley is moved from position A1 (unloading station) towards position A2 (loading station).

Once the trolley is disposed at the loading station (FIGS. 4D to 4G), the operator 45 at his/her work station 15A (or 15C) is therefore facing the console 23 (FIG. 3A) and, at his/her right (or left) is located the unloading deck 14A (or 14C), on which full containers rest and, at his/her left (or right) is located the trolley A2 in standby position. The first operation made by the operator 45, with reference to FIG. 4E, is to register and count the voluminous objects possibly disposed on the lower deck 42 of the trolley. The consumer does not have to unload these voluminous objects which he/she can leave on the lower deck, this presenting a considerable advantage from the standpoint of conviviality. The operator collects the data relative to the voluminous goods 43 conventionally with the aid of the mobile scanner 24. Once all the voluminous goods (disposed on the lower deck) have been registered, the operator may then begin to register and count the articles disposed in the containers standing-by in the unloading station 14A. The customer will have previously placed on the standby trolley an empty container in his/her possession, unless, failing this, the operator places a container taken from the stock at his/her disposal in a cabinet for that purpose.

In accordance with a preferred embodiment, the containers are preferably parallelepipedic and preferably made of plastics material, although they may also be of cardboard or paper, and foldable so as to present a substantially flat shape, therefore of reduced dimensions once folded. The containers once folded are disposed in cabinets for that purpose, near the work stations. For work stations 15B and 15C, the folded containers are stored in the cabinet 28 accessible from one or the other of these stations. For work station 15A, the folded containers are stored in cabinet 51 (FIG. 4E). The customers can use their own containers.

Operator 45, at the beginning of the registering operations, has to his/her left (or right), an empty container disposed on the trolley (placed at the loading station) and at his/her right (or left), an assembly of full containers standing-by and disposed on the unloading deck 27 (27A for example). The operator takes the articles from a first container one by one, registers or counts them with the aid of the scanner, then replaces them in the container disposed on the trolley, until the first container disposed on the unloading deck is emptied, and the first container disposed on the trolley is filled. The operator then takes the container which has just been emptied, from the unloading deck and places it on the trolley. The operations of registering and checking continue in the same manner by emptying each container disposed in standby on the unloading deck and filling the corresponding containers disposed on the trolley, itself placed in the loading station.

The operator therefore passes the articles in front of him/her (arrow n in dotted lines in FIG. 1) and preferably on the work panel 22 (FIG. 3A), provided with a fixed scanner. The mobile scanner 24 (FIGS. 3A and 3B) is used for cumbersome articles or labels with difficult access.

In FIG. 4G, the loading station 16A comprises a sliding deck 50 whose surface corresponds substantially to the surface of the bottom of a container, so that a container can rest on the mobile deck 50. The latter may slide between an active position (FIG. 4G) supporting a container and a retracted, or inactive, position where it is placed on top of the cabinet 51. In a variant, the mobile deck 50 may be mounted to slide, by one of its ends, on a vertical wall of the cabinet 51, the deck being retained by two lateral rods. The deck 50 is thus mobile between an active position perpendicular to the vertical wall of the cabinet 51 and a vertical position folded down against said partition.

Folded containers may be disposed in cabinet 51. In the light of FIG. 4G, it will be understood that the mobile deck 50 serves as temporary support for the container being filled, should the upper deck of the trolley A2 already be laden with a first series of containers and a second series of containers have to be positioned on the first series. The second series in the upper part is therefore elevated. The upper opening of the containers would thus be at a height which would make it inconvenient, if not difficult, for the operator to fill these containers, as he/she would then have to lift the articles up. The mobile deck 50 makes it possible temporarily to place the container being filled at a convenient height.

In order to facilitate emptying of each container disposed on the unloading deck further, the latter is provided, with reference to FIGS. 5 and 6, with an inclined part bearing reference 53. The latter is inclined towards the operator, so that the opening of the corresponding container, bearing reference 54 (FIG. 5), is slightly inclined towards the operator, which increases accessib lity to the inside of the container. The edge 55 of the corresponding unloading deck forms a stop. As an additional safety measure, a board or rail 56 is provided to hold the containers and avoid any untimely tipping over. The solid rail or board 56 also performs another role, namely that of support for the heavy objects taken from the container by the operator, at the work station, in order to dispose them in a container disposed on the trolley at the loading station. In fact, in order to manipulate heavy objects, such as bottles for example, the operator lifts them from the container, leaning the bottle on the rail, then slides the bottle on said rail, thus relieving his/her work when removing the articles from the container during accounting, and disposed on the principal deck 27A of the unloading station 14A.

FIGS. 3A and 3B show a work station provided with a pedestal 21/panel 22/console 23 assembly, mounted to rotate about a vertical axis with respect to the platform 20. The console 23 is displaceable horizontally in order to suit the operator.

The advantage of this characteristic is explained hereinafter.

The use of the work station by an operator has been described hereinbefore, i.e. a person forming part of the staff or working for the store.

According to a very advantageous particularity of the invention, the assembly for checking and accounting the articles is provided with means enabling the consumer/customer to effect him/herself the accounting and registering of the articles that he/she has selected with a view to purchase thereof and disposed in the trolley.

The method of accounting and registering is substantially the same as that described hereinabove, with reference to operations made by an operator. The only difference is that the customer him/herself stands in the work station, facing the console, and accounts the articles by passing them in front of the fixed scanner, and/or uses the mobile scanner to register the voluminous objects disposed on the lower deck of the trolley, or the objects of which access to the bar code is difficult.

To allow the customer to effect these operations by him/herself, it has been provided to mount the work station mobile in rotation. In this way, the work station, and in particular the active part, i.e. the pedestal/console/panel assembly, is mobile between two positions distinct from each other by 180°. In a first position, the assembly of the work station is shown facing the operator (towards seat 18). FIG. 7 schematically shows in plan view the work station 15A, for three different positions of the pedestal 21/work table 22/console 23 assembly. The seat 18A associated with the console is likewise shown.

Figures 7A, 7B, 7C:
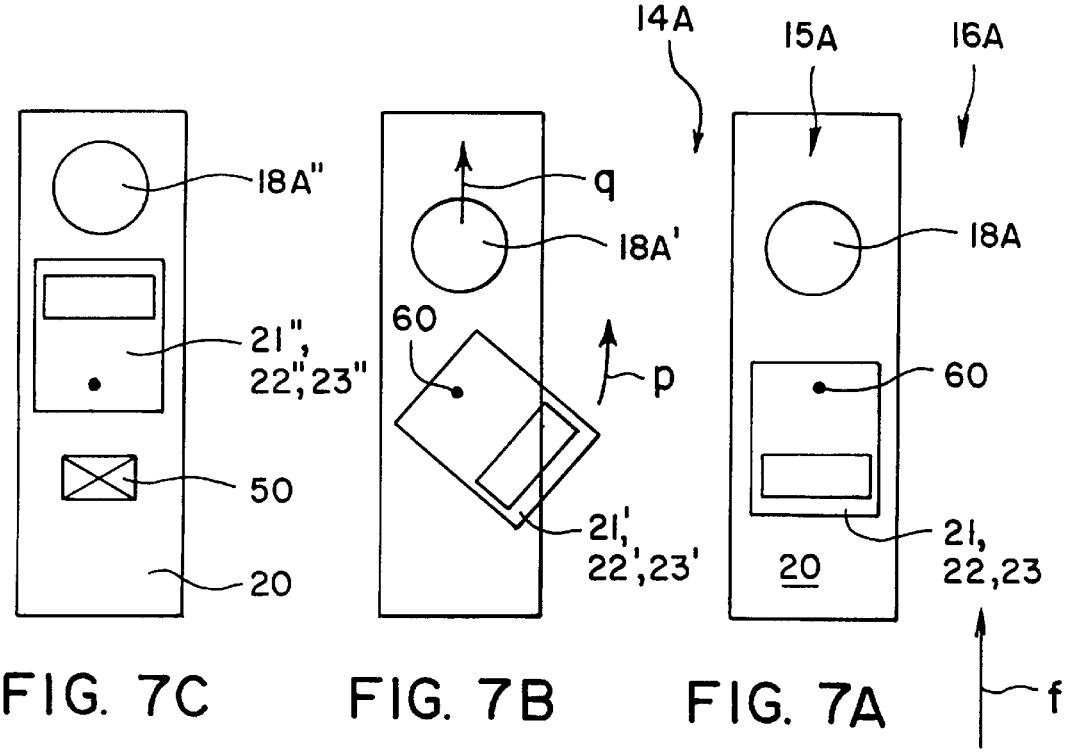
FIGS. 7*a*, 7*b* and 7*c* schematically show in plan view a loading station with the desk in three different positions.

The first position of the work station shown in FIG. 7*a* corresponds to the use thereof by an operator. Said operator is sitting on seat 18A, facing the console 23. This position is referenced hereinafter "downstream position", with respect to the general direction of advance of the customer and represented by arrow f similar to that shown in FIG. 1.

In order to allow the customer to pick up and register the purchases at the work station him/herself, said station undergoes a slight transformation consisting, on the one hand, in displacing the seat 18A downstream (arrow q) and rotating the pedestal/panel/console assembly about the vertical axis of rotation symbolized by reference 60, the work station rotating on itself about said axis, with respect to the platform 20. FIG. 7B shows an intermediate position both of the seat 18A' and of the assembly 21', 22' and 23'.

Displacement of the seat and work station is continued until they come into the positions shown in FIG. 7*c*, where seat 18A" is in maximum downstream position, while assembly 21", 22" and 23" is in position rotated through 180° with respect to the first position (right-hand drawing of FIG. 7).

The axis of rotation 60 of the pedestal and of the console being offset with respect to the centre of the assembly thus formed, rotation of said assembly causes displacement of this pedestal/panel/console assembly downstream. In this way, a place 50 is cleared on the platform 20 (left-hand drawing, FIG. 7C), on which the customer can stand. He/she is then facing the console and in work position, ready to use it. The console and pedestal are shown in so-called "upstream" position (i.e. the active face of the console facing upstream).

This configuration presents a considerable advantage since it enables the consumer to register the goods him/herself in the event of unforeseen crowds. From the checking standpoint, it is possible, for example, to provide for a unit, such as unit 13 in FIG. 1, two assemblies each used by an operator (store staff) and the third assembly by the customer, which enables the operators of the first two respective stations to monitor the registering operations made by the customer him/herself at the third station.

Figure 8:
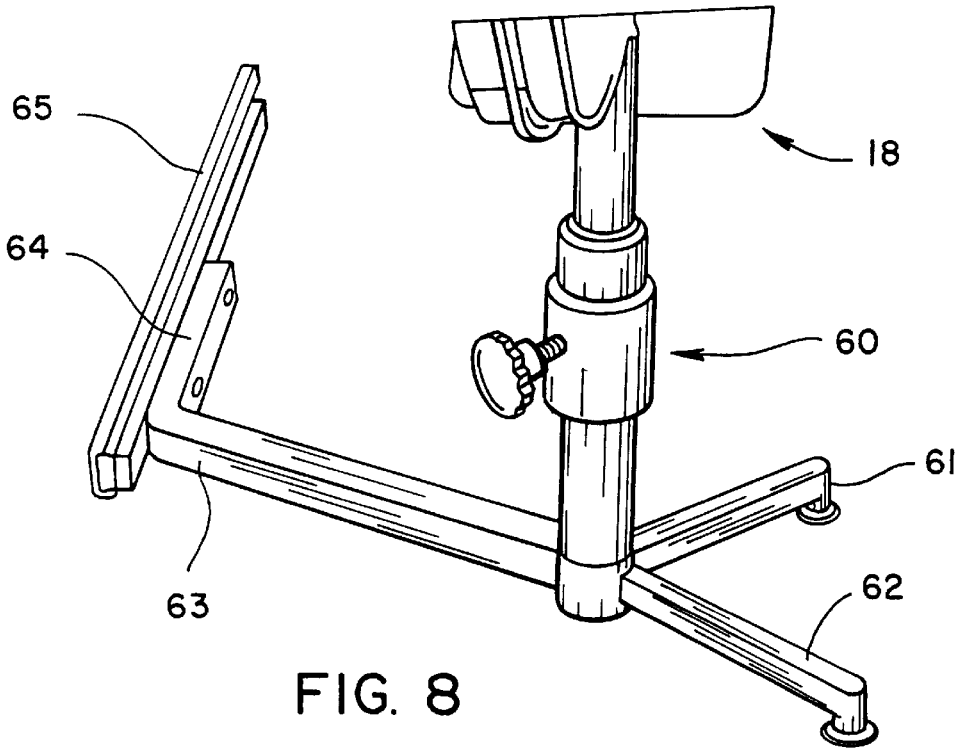
FIG. 8 shows a view in detail of the means for sliding the seat of a work station.

The seat 18A may slide with respect to the platform 20, by any known means. FIG. 8 shows a detailed view of the foot 60 of the seat 18, comprising three branches 61, 62 and 63, regularly offset angularly, providing a stable base for said seat. One of the floor-engaging branches 63 is fast with a slide block 64, itself adapted to cooperate with a slideway 65 fixed to the platform 20.

Once the customer's trolley is again laden with the goods, the latter having been accounted and registered, the customer then moves it towards one of the payment stations, and preferably the nearest one. For example, with reference to FIG. 1, the customer coming from assembly A moves his/her trolley from position A2 towards position A3 then A4, towards payment station 8. Concerning assembly C, the customer moves his/her trolley from position C2 towards position C3. For assembly B, the customer moves his/her trolley from position B2 towards position B3. Finally, for one of the assemblies, referenced D, of the adjacent unit 13', the customer moves his/her trolley from position D2 towards position D3.

Figure 9:
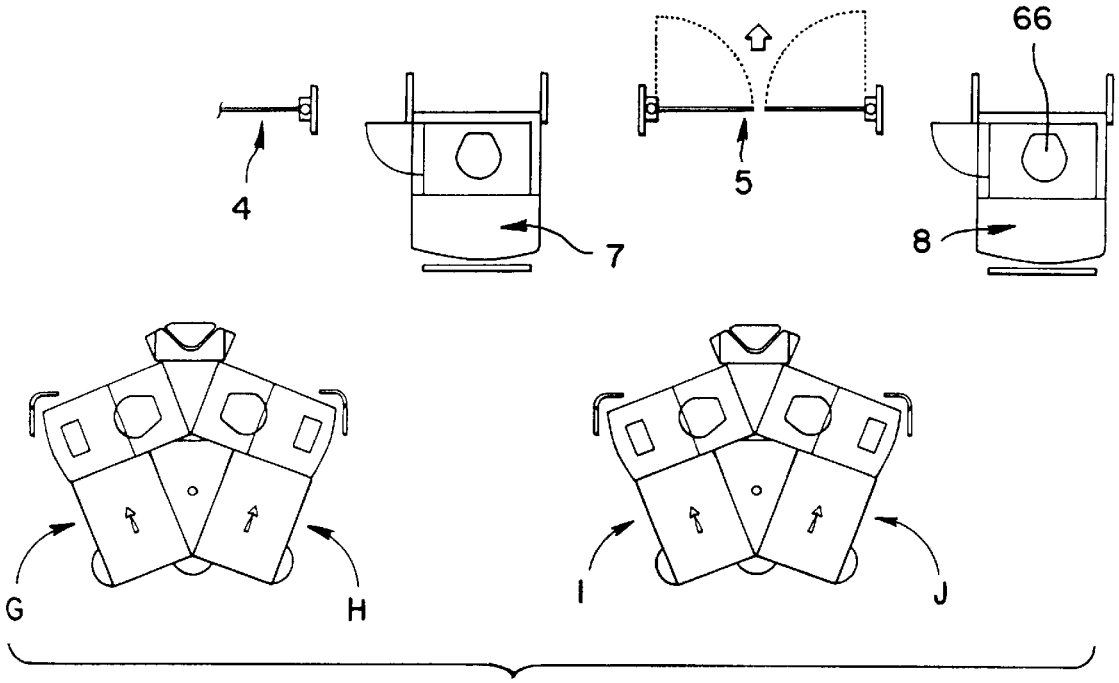
FIG. 9 shows a schematic plan view of a variant implantation.

FIG. 9 shows a plan view, similar to that of FIG. 1, of a variant embodiment comprising units, each presenting two assemblies of the invention, disposed in V-form. In comparison, the units of the embodiment shown in FIG. 1 comprise three assemblies disposed in Y-form. The V-assemblies of each unit shown in FIG. 9 form a V open towards the exit of the store, the point being directed towards the shelves. Similar or identical elements shown in FIG. 1 and in the variant of FIG. 9 bear the same references.

Units coupled in two's may also be provided, each unit comprising two assemblies forming a V, the two units thus being disposed to form a double chevron.

Figure 10:
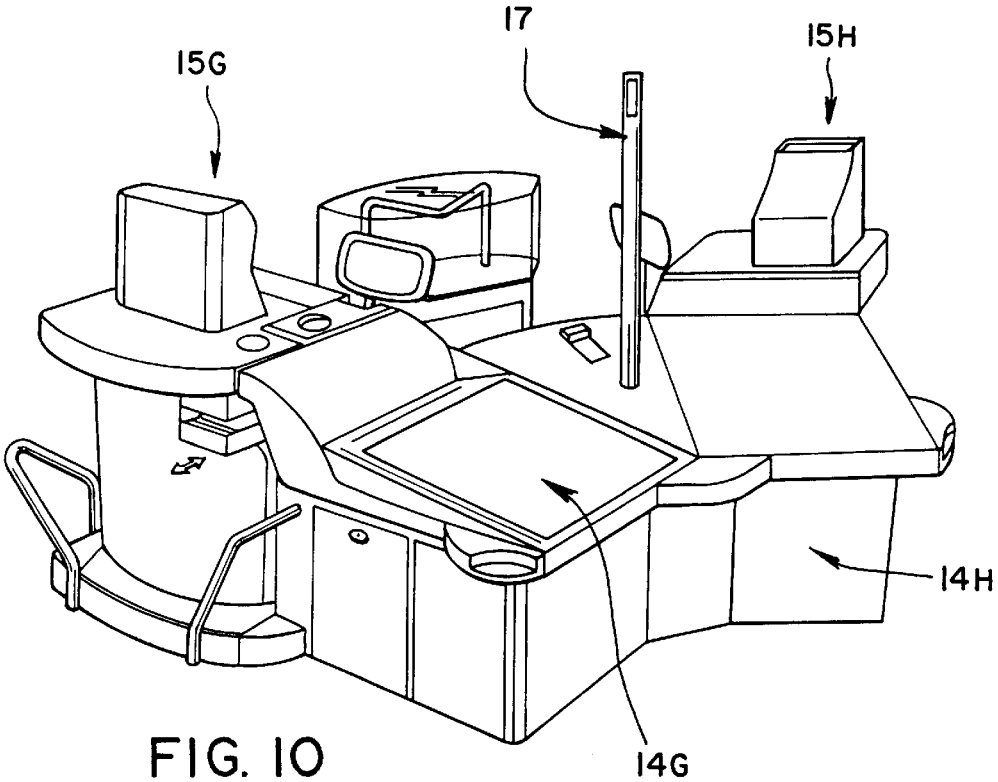
FIG. 10 is a view in perspective of a unit of two assemblies arranged as a V.

FIG. 10 schematically shows a view in perspective of a unit comprising two assemblies forming a V. Elements and means similar to those of FIGS. 1 to 8 bear the same references. It should be noted that, according to this variant, each assembly comprises a single unloading station, i.e. similar to assemblies B and C of FIG. 1, contrary to assembly A whose unloading station 14A comprises two decks, for reasons for example of bulk.

Figure 12:
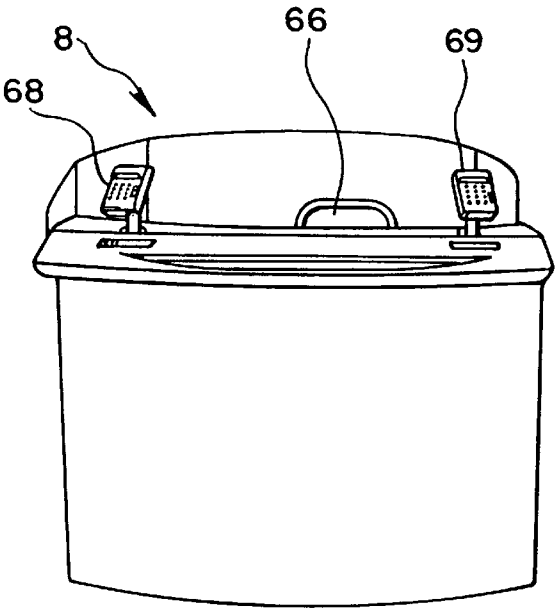
FIGS. 11 and 12 show views in perspective of a payment station, in side and front view, respectively.
Figure 11:
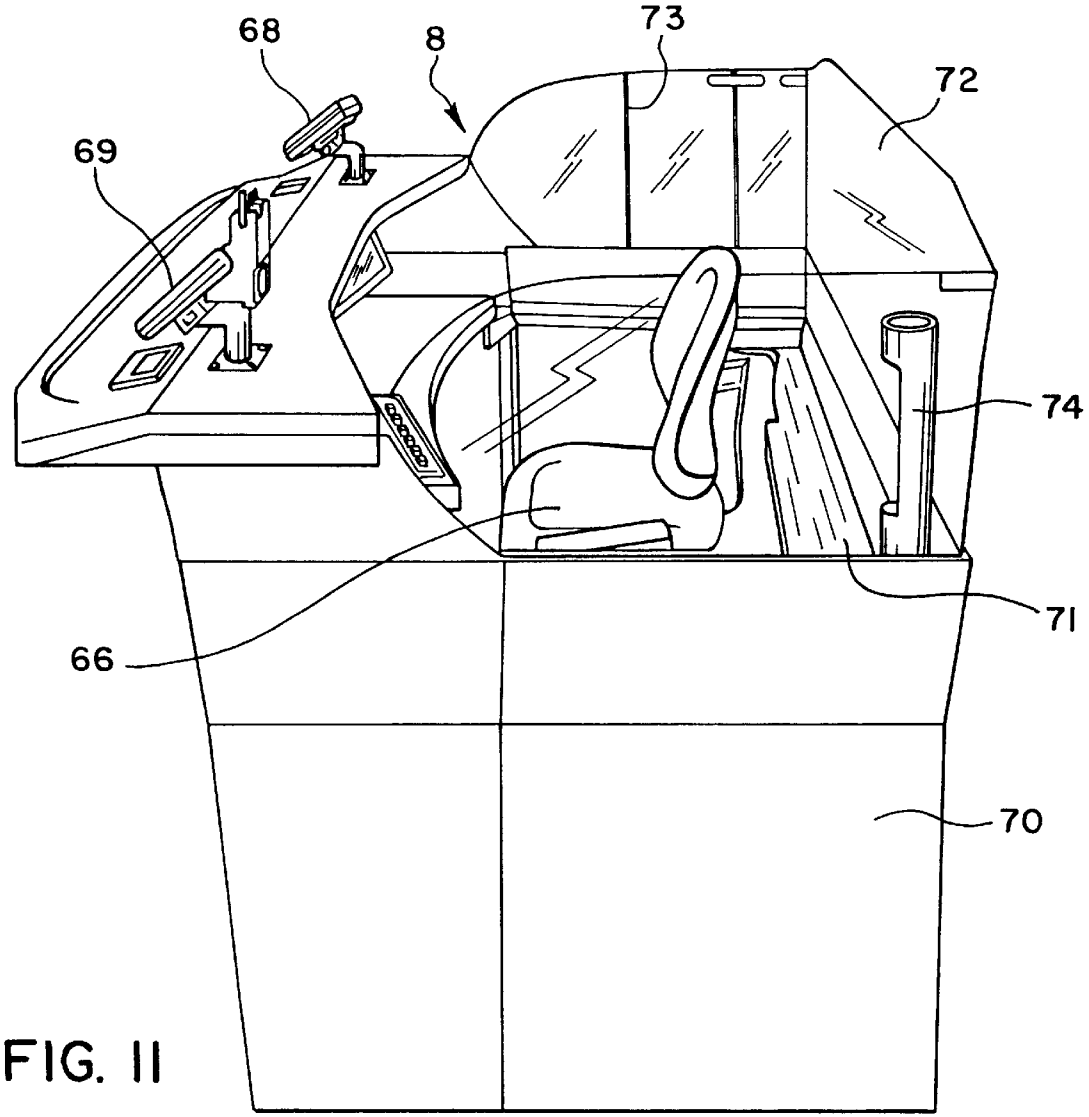

The payment stations located at the exit of the store will now be described in greater detail, with reference to FIGS. 1, 11 and 12.

Each payment station is constituted by a cubicle of generally cubic shape, closed by partitions to define an inner space in which a seat 66 is provided. The cubicle constituting the payment station comprises a flat part, in the form of a deck 67 provided for the operations relative to a given customer and a given trolley, arranged on either side of the work station (cf. FIG. 1).

One of the sides of cubicle 8 may be temporarily closed by a door 70. Panels 71, 72 and 73 made of rigid transparent material are arranged on the sides and behind the cubicle 8, around the upper part, in order to isolate the operator.

The operator of the payment station has various means available, known per se and which are not described in greater detail, for cashing and registering the payment by the customer for the goods that he/she has purchased and placed in his/her trolley, and which have just been registered with the aid of the assemblies described hereinabove. Such means include, inter alia, payment card recording devices 68 and 69.

The payment stations are advantageously provided with pneumatic distributing and routing means 74 in order to enable the operators of each payment station to route, under optimum security conditions, the cash, cheques or any other important and precious document from their payment station towards the central cashdesk or any determined point of the store.

The payment station also serves to check the operations of registering. In fact, the operator of the payment station may monitor and check execution of the operations taking place at each unit and at each article registering and accounting assembly, particularly in the case of these operations being carried out by the customer him/herself.

The invention is not limited to the embodiment described, but covers, on the contrary, all variants thereto.

What is claimed is:

1. Assembly for checking and registering purchases made by a consumer in a self-service sales point, of the type comprising a station for unloading said purchases, a work station provided with means for registering and accounting said purchases adapted to be occupied by one person, the work station is mounted to rotate about a vertical axis, with a view to rotating the operational face either upstream or downstream, allowing said work station to be used equally well either by a customer in position facing upstream or by a staff operator in position facing downstream, said work station comprises a seat for the operator mounted to slide between an active position for use by an operator and a retracted position for use by the customer, a loading station, wherein said respective unloading and loading station being placed substantially opposite each other an on either side of said work station, the loading station comprising a location adapted to receive a trolley, said person facing the registering and accounting means having at his/her right or left the unloading station and at his/her left or right, respectively, the trolley, said three stations being substantially of general direction parallel to the general direction of advance and displacement of the consumer, and said person, at his/her work sation, being liable to face said direction, wherein a principal deck comprises a part whose surface corresponds substantially to a container.

* * * * *